United States Patent [19]

Furukawa

[11] Patent Number: 4,843,796

[45] Date of Patent: Jul. 4, 1989

[54] METHOD AND APPARATUS FOR VACUUM PACKAGING

[75] Inventor: Takao Furukawa, Onomichi, Japan

[73] Assignee: ECS Corporation, Japan

[21] Appl. No.: 171,898

[22] Filed: Mar. 22, 1988

[51] Int. Cl.[4] ..... B65B 31/02

[52] U.S. Cl. ..... 53/434; 53/468; 53/512; 53/571

[58] Field of Search ..... 53/434, 432, 512, 510, 53/573, 572, 571, 570, 468, 459, 442

[56] References Cited

U.S. PATENT DOCUMENTS

| | | | |
|---|---|---|---|
| 3,958,391 | 5/1976 | Kujubu | 53/434 |
| 3,982,376 | 9/1976 | Ikeda | 53/53 |
| 4,550,548 | 11/1985 | Owensby et al. | 53/434 |
| 4,580,393 | 4/1986 | Furukawa | 53/512 |
| 4,723,392 | 2/1988 | Takeda | 53/434 |

FOREIGN PATENT DOCUMENTS

| | | | |
|---|---|---|---|
| 2526101 | 5/1976 | Fed. Rep. of Germany | 53/512 |

*Primary Examiner*—James F. Coan

*Attorney, Agent, or Firm*—Barnes, Kisselle, Raisch, Choate, Whittemore & Hulbert

[57] ABSTRACT

The invention relates to a method and apparatus for vacuum-packaging material in a soft flat packaging bag. Packaging bags filled with a material are supported in a plurality of holders in advance in a place other than a plurality of vacuum chambers adapted to be intermittently rotated along a circular path. Such holders are successively fed to the vacuum chambers. While a vacuum chamber which has been fed with such holder is rotating along the circular path, this vacuum chamber is evacuated, the opening section of the packaging bag is sealed and then the vacuum chamber is opened to the surrounding atmosphere. And the packaging bag which has completed vacuum packaging is withdrawn from the vacuum chamber. Since the vacuum chamber is fed with a relatively large-sized holder rather than a soft flat bag which is difficult to handle, errors in feeding are avoiding.

13 Claims, 10 Drawing Sheets

METHOD AND APPARATUS FOR VACUUM PACKAGING

FIELD OF THE INVENTION

The present invention relates to a method and apparatus for vacuum packaging, wherein a short flat packaging bag filled with a material is vertically supported and received in a chamber so that said material will not fall out of the packaging bag, and in said chamber, said material is then vacuum-packaged using said packaging bag.

BACKGROUND OF THE INVENTION

In piece commodities, such as pickles containing seasoning liquids or candies, the seasoning liquids or the commodities themselves tend to fall out of the packaging bags. As an approach to this problem, U.S. Pat. No. 4,580,393 or U.S. patent application No. 06/919,649 discloses an apparatus for vacuum packaging a material by feeding a soft packaging bag, in its flat form, to a clamper which is rotated integrally with a vacuum chamber by a rotor, clamping the bag in a suspended state by the clamper, opening said packaging bag to put a material therein, feeding said packaging bag to a vacuum chamber, where said material is vacuum-packaged.

In said apparatus, a number of clampers are moved along a circular path and successively stopped at a bag feeding position, while in said bag feeding position packaging bags are pneumatically attracted one by one, by a vacuum cup, from the top of a stack of packaging bags and transferred to the clampers. However, during the time such operation is repeatedly effected in harmony with the movement of the clampers, there occur such errors as the vacuum cup failing to attract a packaging bag owing to a distortion in the bag, a packaging bag falling from the vacuum cup owing to air resistance when it is transferred by the vacuum cup to a clampers, and the clamper failing to clamp the packaging bag correctly. Besides these, there also occurs an error when the packaging bag is opened, resulting in a material to be packaged being discharged outside the packaging bag during filling operation. Thus, such apparatus has a drawback that such errors, occurring at a rate of 2–3%, cannot entirely be eliminated.

DISCLOSURE OF THE INVENTION

With the above in mind, an object of the invention is to make it possible to feed a packaging bag, supported on a holder upon completion of filling with a material, to a vacuum chamber, dismissing the prior conception of supplying the soft and awkward packaging bag to the chamber in a flat state.

To achieve this object, a method of vacuum-packaging a material in a soft flat packaging bag according to the invention comprises the steps of:

intermittently rotating a plurality of vacuum chambers along a circular path, supporting said packaging bags filled with said material respectively on a plurality of holders in such a manner that the bags are kept opened with their openings turned up, and transferring these holders along a transfer path, feeding one holder supporting a packaging bag filled with said material into a vacuum chamber from feeding means installed at the terminal end of said transfer path correspondingly to one of the stop positions of the vacuum chambers in said circular path, evacuating said vacuum chamber and closing the opening in the packaging bag while said vacuum chamber is rotating along said circular path, and opening said vacuum chamber to the surrounding atmosphere and taking out the holder from said vacuum chamber.

An apparatus for vacuum-packaging a material in a soft flat packaging bag according to the invention comprises:

a holder movable on a transfer path and capable of supporting a soft packaging bag in the opened state with its opening turned up, means for feeding a packaging bag to said holder so as to support the bag in the holder, means for filling a material, on said transfer path, into the packaging bag supported on said holder, a plurality of vacuum chambers intermittently rotated along a circular path, means installed at the terminal end of said transfer path correspondingly to one of the stop positions of the vacuum chambers in said circular path, and capable of feeding one holder supporting a packaging bag filled with said material into a vacuum chamber, wherein while said vacuum chamber is rotating along said circular path, said vacuum chamber is evacuated and the opening in the packaging bag is closed, whereupon the vacuum chamber is opened to the surrounding atmosphere, and means for taking out the holder from said vacuum chamber opened to the surrounding atmosphere.

A second apparatus for vacuum-packaging a material in a soft flat packaging bag according to the present invention comprises:

a plurality of vacuum chambers intermittently rotated along a first circular path, a plurality of retainers intermittently rotated along a second circular path disposed adjacent said first circular path in synchronism with the rotation of said vacuum chambers, wherein of said plurality of retainers in the stopped state, two are opposed to two vacuum chambers which are present at a packaging bag take-in position and at a packaging bag take-out position in the stopped state, said apparatus having a holder capable of supporting said soft packaging bag with its opening turned up, said holder being adapted so that it can be supported on said retainers, transferred between the retainer and vacuum chamber at said pair of opposed positions and received in said vacuum chambers, said apparatus having, along said second circular path, means for feeding a packaging bag to the holder on said retainer to cause said holder to support said packaging bag, means for filling a material into the packaging bag supporting by said holder, and means for feeding said holder, with said material filled thereinto, from said retainer at said packaging bag take-in position into the vacuum chamber, wherein while said vacuum chamber is rotating along the first circular path, the chamber is evacuated, the opening in said packaging bag is sealed and thereafter the vacuum chamber is opened to the open air, and said apparatus having, along said second circular path, means for taking out the holder from the vacuum chamber at said packaging bag take-out position and delivering the holder onto the retainer, and means for transferring the packaging bag on the holder, delivered onto the retainer, to carrying-out means.

Thus, in the present invention, packaging bags filled with a material are supported on a plurality of holders in advance in a place other than the vacuum chambers; such holders can be successively fed to the vacuum chambers. According to this, since relatively large holders are fed rather than feeding soft flat packaging bags, which are difficult to handle, directly to the vacuum chambers, there is an advantage that on error in feeding occurs and hence there is no trouble associated therewith.

DESCRIPTION OF THE EMBODIMENTS

Figure 1:
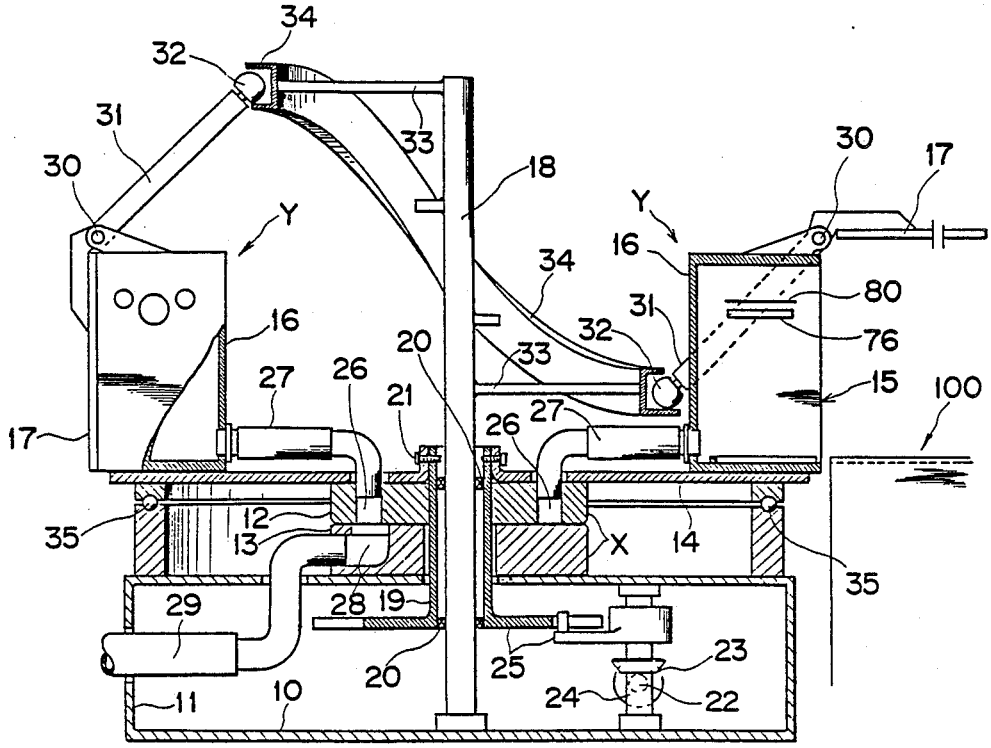
FIG. 1 is a front view, in longitudinal section of an embodiment of an apparatus according to the invention.

In FIG. 1, a table 11 is fixedly placed on a machine frame 10, and a rotor 14 in the form of a circular plate is disposed above said table 11 through a rotary valve X consisting of two circular members 12 and 13. Placed on the peripheral edge of the rotor 14 are vacuum chambers Y, each consisting of a container 16 with its open surface 15 directed outward and a cover member 17 adapted to open and close the open surface 15 of said container 16.

Figure 2:
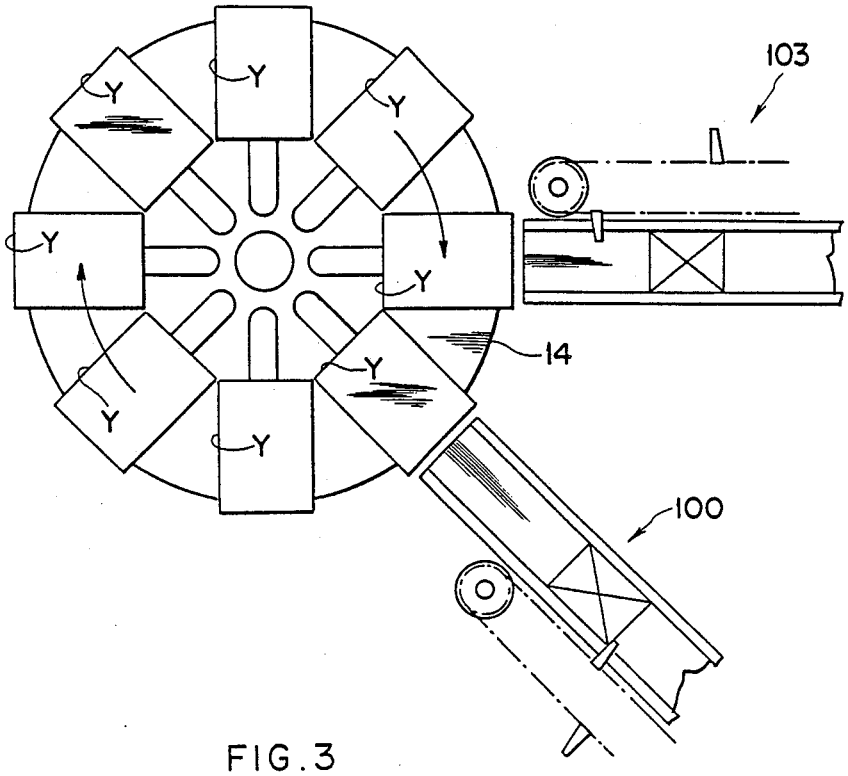
FIG. 2 is a plan view schematically showing the apparatus of FIG. 1.

As shown in FIG. 2, eight vacuum chambers Y are angularly equispaced on the peripheral edge of the rotor 14. Further, in FIG. 1, a spindle 18 fixed at its lower end to the machine frame 10 extends centrally through the rotary valve X, and a cylindrical main shaft 19 is fitted on said spindle through ball bearings 20, the upper end of said main shaft 19 being fixed to the rotor 14 by bolt and nut means 21. The lower end of the main shaft 19 is engaged with a drive shaft 24 through a Geneva stop 25, said drive shaft 24 being connected to a prime mover shaft 22 through a bevel gear 23. This arrangement transmits the power from the drive shaft 24 to the main shaft 19 and rotor 14 through the Geneva stop 25 so that, in FIG. 2, the eight chambers Y are intermittently rotated in the direction of arrow with the same pitch as the installation spacing of said chambers. The numeral 35 denotes rollers, rotatably supporting the rotor 14. In FIG. 1, the rotary valve X has its lower member 13 fixed to the table 11 and its upper member 12 to the rotor 14, so that the rotation of the rotor 14 causes the contact surfaces of these two members 12 and 13 to slide along each other.

The upper member 12 of the rotary valve X is formed with eight vertical holes 26 which are connected to the vacuum chambers Y through pipes 27. The lower member 13 of the rotary valve X is connected to a vacuum pump (not shown) by a hose 29, so that the rotation of the rotor 14 causes the eight holes 26 formed in the upper member 12 to communicate successively with a vacuum port 28 formed in the lower member 13. Thus, a vacuum is created in a vacuum chamber Y communicating with the vacuum pump through the rotary valve X.

In each vacuum chamber Y, the upper edge of the cover member 17 is pivotally connected to the container 16 by a hinge type support shaft 30, so that the cover member 17 can be vertically opened and closed with respect to the container 16. An arm 31 connected to one end of the support shaft 30 is extended toward the center of the rotor 14, and a roller 32 is provided on the extended end of said arm 31. Such rollers 32 are engaged with an endless groove type guide rail 34. As the vacuum chambers Y are moved along a circular path by the rotation of the rotor 14, each cover member 17 opens and closes the open surface of the associated container 16 by utilizing the slope of the guide rail 34. When the open surface 15 of the container 16 is closed by the cover member 17, a vacuum acts in the sealed vacuum chamber Y through the rotary valve X. In FIG. 2, two or three vacuum chambers Y are present in a range of about 90 degrees of the the rotor 14, and a vacuum is brought about in this 90-degree range; three vacuum pumps are separately used to avoid a phenomenon of short-circuiting between the vacuum chambers Y.

Figure 4:
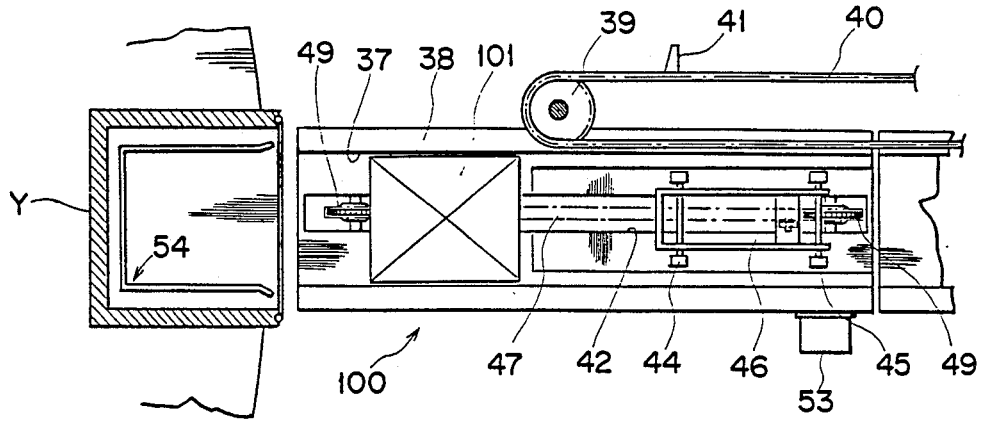
FIG. 4 is an enlarged plan view of a feeding device shown in FIG. 2.
Figure 5:
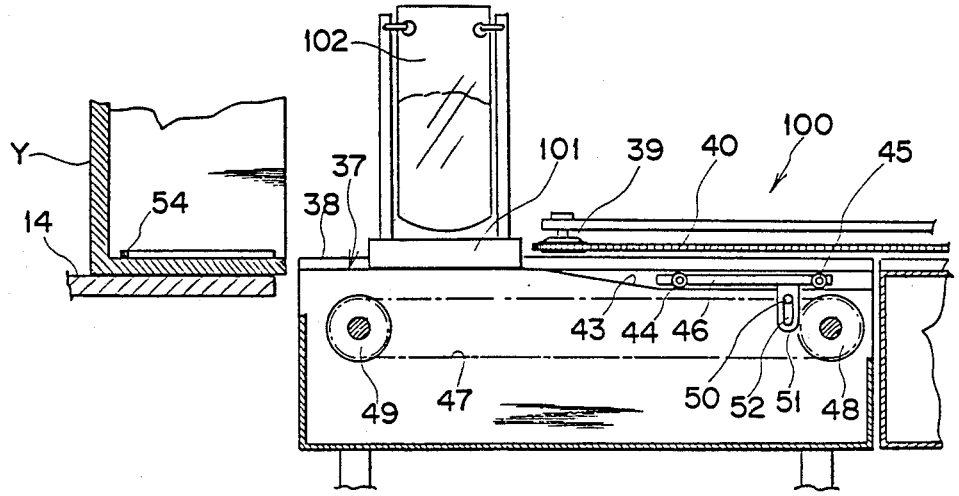
FIG. 5 is a front view of the feeding device shown in FIG. 4.

In FIG. 2, at one of the stop positions of the vacuum chambers Y, a feed device 100 is installed to face the open surface 15 of the vacuum chamber Y. The feed device 100, as shown in FIGS. 4 and 5, comprises a guide base 38 having a shallow groove 37 in the upper surface thereof, and a chain 40 entrained around a plurality of chain wheels 39 laterally of said guide base 38. Feed pawls 41 equispaced along the chain 40 transfer holders 101 onto the guide base 38 at the same intervals of time as those with which the vacuum chambers Y are stopped toward the feed device 100 during their movement. A portion of the groove 37 of the guide base 38 is depressed to define a storage section 43, in which a pusher 46 supported by four wheels 44, 44 and 45, 45 is stored. An endless chain 47 is entrained around two chain wheels 48 and 49 and is provided with a pin 50 fitted in an elongated opening 52 formed in s trip 51 suspended from said pusher 46 to extend centrally through a slit 42 formed in the guide base 38. A motor 53 fixed on the lateral surface of the guide base 38 is connected to the shaft of the chain wheel 48.

Thus, when the pusher 46 takes the stored position in the storage section 43, the pawl 41 provided on the chain 40 moves the holder 101 forward over the pusher 46. When the holder 101 is stopped, the motor 53 starts to drive the chain 47, pushing the pusher 46 up along the slope of the storage section 43, so that the pusher 46 pushes the holder 101 to the position fo a stopper 54 formed on the bottom surface of the interior of the vacuum chamber Y. Thereafter, the pusher 46 is moved back into the storage section 43 by the return action of the chain 47, allowing the passage of the following holder 101.

Figure 7:
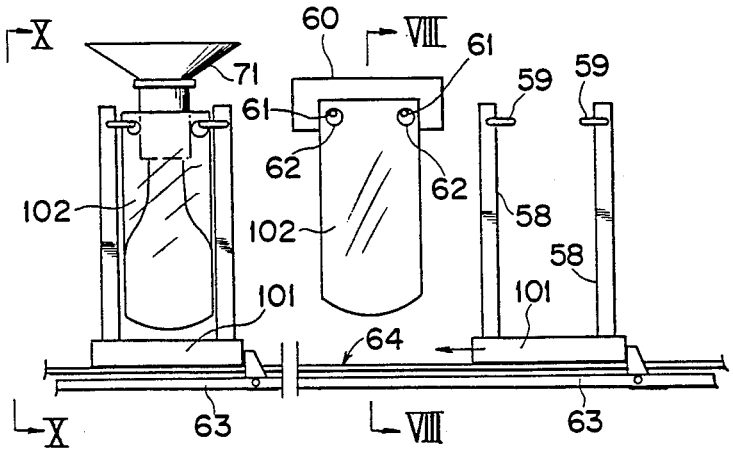
FIG. 7 is a front view showing a place upstream of the place shown in FIG. 4 in the feeding device of FIG. 4.
Figure 8:
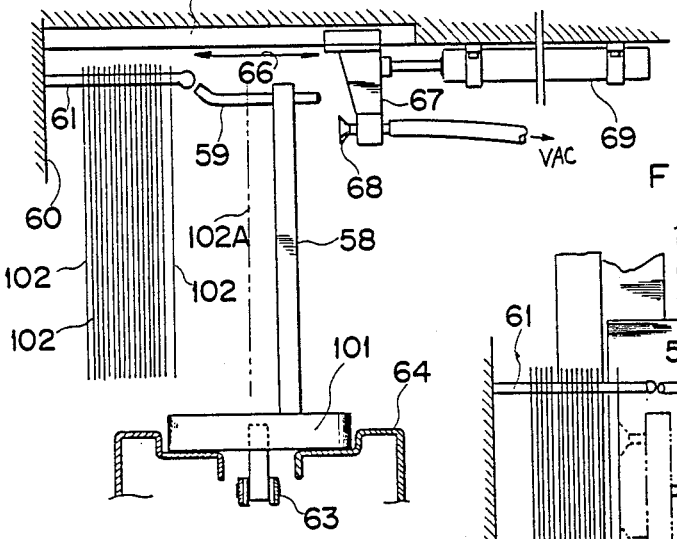
FIG. 8 is a view taken along the line VIII—VIII in FIG. 7.
Figure 9:
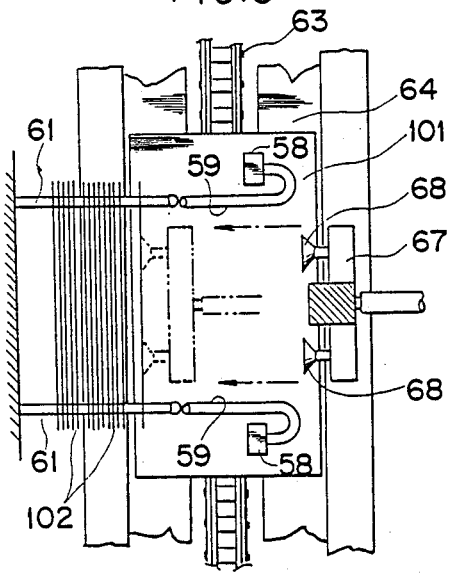
FIG. 9 is a plan view of a portion shown in FIG. 8.

As shown in FIGS. 7 through 9, two pillars 58 are provided on the upper surface of the holder 101, and hooks 59 are fixed to the upper ends of the pillars 58. On the side upstream of the feed device 100, two rods 61 extend from a wall 60 laterally of a conveyor for conveying holders 101, and a number of soft packaging bags 102 each having two holes 62 are suspended from said rods 61.

As shown in FIGS. 8 and 9, when the holder 101 conveyed on a plate 64 by being pushed by chain 63 stops in front of the two rods 61, vacuum cups 68 integral with a block 67 so that it can be reciprocated in the direction of arrow 66 along an upper guide 65 are pushed by an air cylinder 69. The vacuum cups attract one of the packaging bags 102 and move it to the position of the hooks 59 as indicated by a phantom line 102A, where this one packaging bag 102 is supported by the holder 101.

Figure 10:
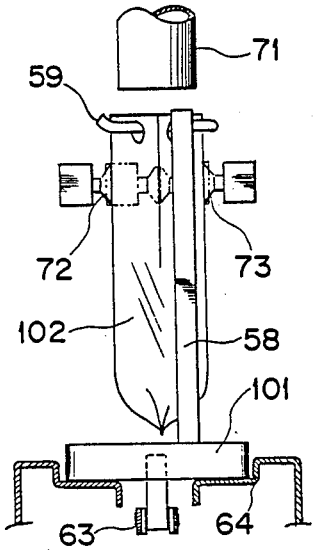
FIG. 10 is a view taken along the line X—X in FIG. 7.

In FIG. 7, the holder 101 supporting the packaging bag 102 is conveyed to a place under a hopper 71, where it stops. When the holder 101 stops under the hopper 71, as shown in FIG. 10, vacuum cups 72 and 73 approach the packaging bag 102 from its opposite surfaces to attract them, whereupon the cups 72 and 73 pull said surfaces away from each other in opposite directions, thereby opening the open edge of the packaging bag 102. The hopper 72 is inserted into the opened packaging bag 102, and minced beef or pork, for example, is filled into the packaging bag 102 through the hopper 71. In this manner, packaging bags 102 each filled with a material to be packaged are supported in the holders 101, and the holders 101 are fed one by one into the vacuum chambers Y by the feed device 100 shown in FIG. 1.

Figure 3:
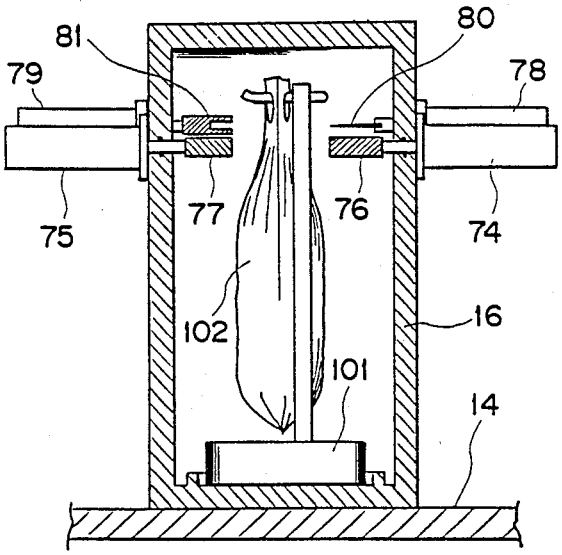
FIG. 3 is a front view, in section, of one chamber shown in FIG. 1.

As shown in FIG. 3, a seal bar 76 and a seal receiver 77 are respectively installed on the front ends of the piston rods of a pair of air cylinders 74 and 75 installed on the outer sides of opposed walls of the container 16 forming the vacuum chamber Y. After a vacuum is created in the container 16, the seal bar 76 and the seal receiver 77 move toward each other to hold the packaging bag 102 therebetween to heat-seal the bag 102. A cutting blade 80 and a blade receiver 81 of groove-shaped cross section are respectively installed on the front ends of the piston rods of another pair of air cylinders 78 and 79, said cutting blade 80 and blade receiver 81 cooperating with each other to form a cut in the heat-sealed area.

Figure 6:
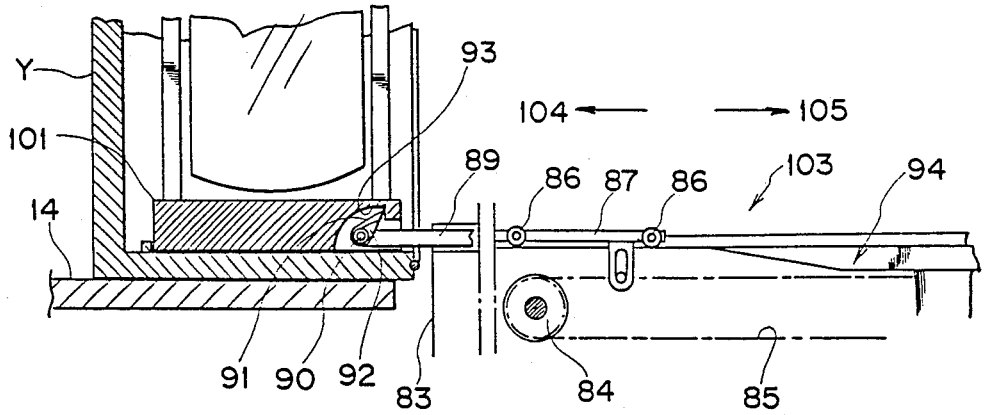
FIG. 6 is an enlarged front view of a take-out device shown in FIG. 2.

As shown in FIG. 2, a take-out device 103 is installed adjacent the feed device 100. Thus, the packaging bag 102 fed to the vacuum chamber Y by the feed device 100 is transferred together with the vacuum chamber Y by the rotor 14, and after it is subjected to a vacuum in the vacuum chamber Y during transfer, the cover member 17 of the vacuum chamber Y is opened again at the position where said take-out device 103 is installed. As shown in FIG. 6, in the take-out device 103, an endless chain 85 entrained around a pair of chain wheels 84 (one of which is shown) is installed in a casing 83, said chain 85 being connected to a withdrawal frame 87 supported by a plurality of wheels 86 on the casing 83, so that the travel of said chain 85 causes the withdrawal frame 87 to be reciprocated on the upper surface of the casing 83.

The withdrawal frame 87 comprises a rod member 89 having a pawl 91 pivotally supported on the front end thereof by a pin 90, said pawl 91 being constantly urged upright by a torsion coil spring 92 wound on said pin 90. The lower surface of the holder 101 is formed with a hook-shaped recess 93 for engagement with the pawl 91. Therefore, when the withdrawal frame 87 is moved in the direction of arrow 104, i.e., toward the vacuum chamber Y, by the chain 85, the pawl 91 on the front end is raised upright inside the recess 93 by the reaction of the spring 92, catching the hook-shaped recess 93. The vacuum chamber Y is withdrawn from the vacuum chamber Y by the withdrawal frame 87 moving in the direction of arrow 105, i.e., away from the vacuum chamber Y. When the withdrawal frame 87 sinks into the storage section 94 formed on the upper surface of the casing 83, the holder 101 is disengaged from the pawl 91.

Figure 13:
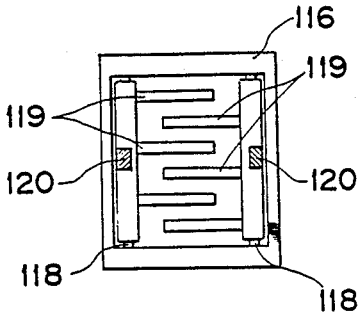
FIG. 13 is a view taken along the line XIII—XIII in FIG. 12.
Figure 12:
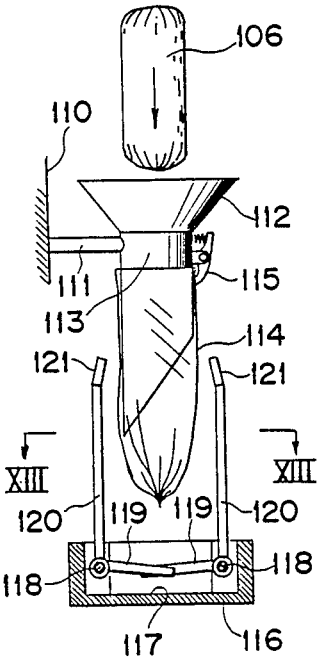
FIG. 12 is a front view of a filling device applied to a second embodiment of a holder.
Figure 11:
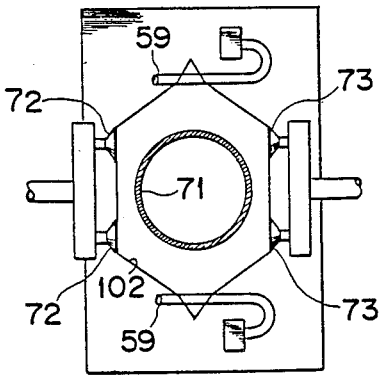
FIG. 11 is a plan view of a portion shown in FIG. 10.
Figure 14:
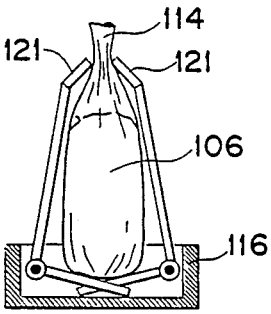
FIG. 14 is a front view showing a packaging bag filled with a material and supported by a holder shown in FIG. 12.

The embodiment described above and shown in FIGS. 7 through 11 has been suitable for packaging a soft flowable commodity such as minced meat in a soft bag; as an embodiment suitable for packaging a solid commodity such as ham or sausage in a bag, there is one shown in FIG. 12. In this embodiment, a soft packaging bag 114 is fitted over the discharge sleeve 113 of a hopper 112 supported on a wall surface 110 by a bracket 111 and is fixed in position by a clamper 115, whereupon a solid commodity 106 is filled into the packaging bag 114 through the hopper 112. Then, a holder 116 is placed under the hopper 112 and the clamper 115 is released. A recess 117 is centrally formed in the upper surface of the holder 116, and a pair of comb members 119 are rotatably supported on pins 118 on opposite sides of the recess 117 and are opposed to each other as shown in FIG. 13. Poles 120 are erected on the comb members and clamp plates 121 are installed on the poles 120. As a result, as shown in FIG. 14, the commodity 106 sits on the comb members 119 and the mouth of the packaging bag 114 is flattened, as it is pressed by the clamp plates 121 from opposite sides, to the extent that a slight clearance remains. Such holder 116 is fed to the vacuum chamber Y and the solid commodity 106 is vacuum-packaged. In this case, since the mouth of the packaging bag 114 has been flattened, it can be easily vacuum-sealed.

Figure 15:
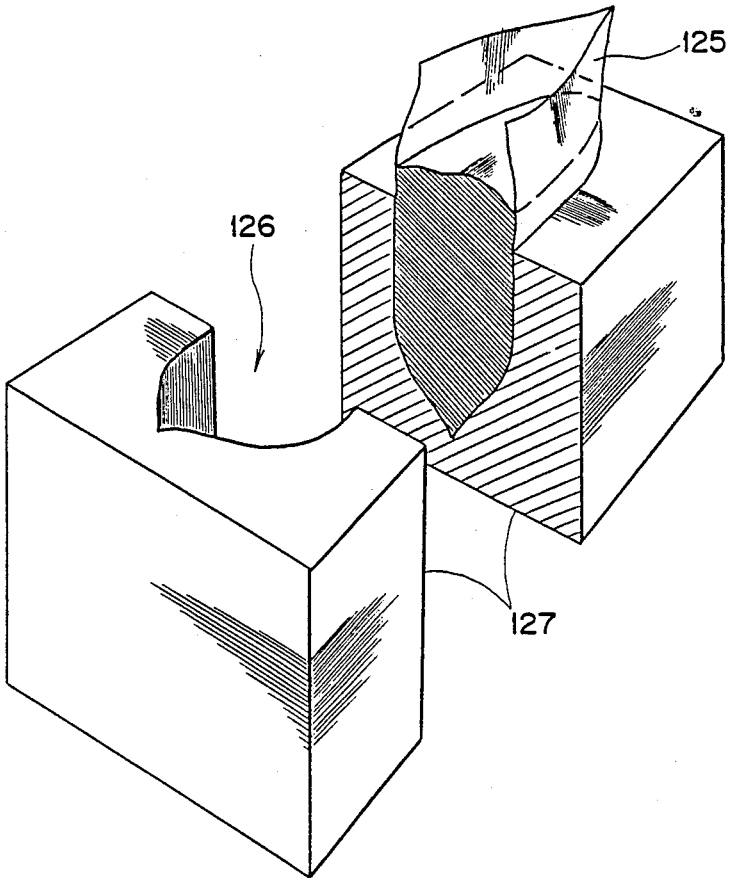
FIG. 15 is a perspective view, partly broken away, a third embodiment of a holder together with a packaging bag supported by said holder and a material filled into said packaging bag.
Figure 16:
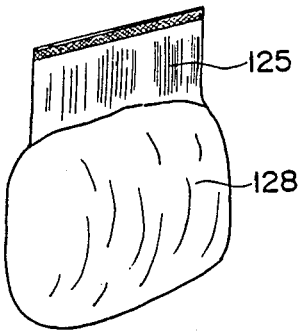
FIG. 16 is a perspective view showing a highly flowable material vacuum-packaged as it is collected in the bottom of a packaging bag.
Figure 17:
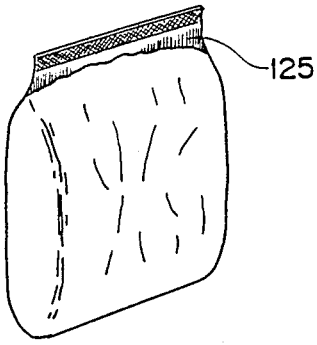
FIG. 17 is a perspective view showing a highly flowable material vacuum-packaged as it is evenly spread throughout the interior of a packaging bag.

When a highly flowable commodity such as minced meat containing a liquid is to be packaged, it is desirable to use a holder 127 formed with a recess 126 for receiving a packaging bag 125 as shown in FIG. 15. If a packaging bag 125 filled with a highly flowable commodity such as the one described above is suspended in the vacuum chamber and subjected to a vacuum, the commodity 128 deposits in the lower section of the packaging bag 125, as shown in FIG. 16. However, if the opposite surfaces of the packaging bag are pressed by the surface of the recess 126, as shown in FIG. 15, and then the commodity is subjected to a vacuum, it is packaged in such a manner that it spreads throughout the interior of the packaging bag 125, as shown in FIG. 17; thus, a neat product can be formed.

Figure 18:
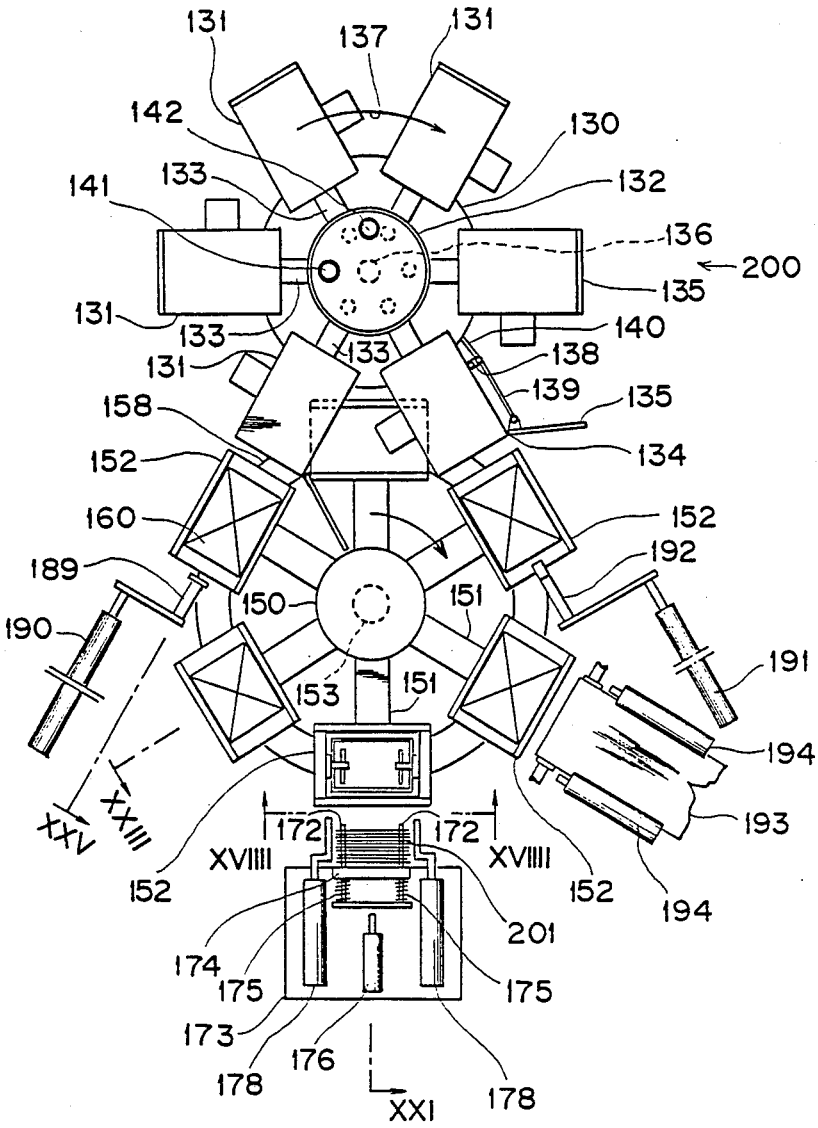
FIG. 18 is a plan view of another embodiment of an apparatus according to the invention.

FIG. 18 shows another embodiment of the invention. Six chambers 131 are attached to the periphery of a rotor 130 with the opening surfaces of said chambers 131 directed outward, and a rotary valve 132 installed at the center of the rotor 130 is connected to said chambers 131 through pipes 133. Each chamber 131 has a cover member 135 attached to the outer opening surface thereof so that it can be opened and closed around an axis 134 extending along one opening edge of the chamber. The rotor 130 is intermittently rotated in increments of 60 degrees by a central shaft 136, so that the chambers 131 are intermittently rotated in the direction of arrow 137 with the same pitch as the chamber disposition spacing. Though shown in only one of the six chambers 131, the cover member 135 is connected through a link 139 to a lever 138 disposed on a lateral surface of the chamber 131, said lever 138 being engaged by a grooved cam installed on the lower side of the rotor 130 through a rod 140, said grooved cam being adapted to open the cover member 135 of the chamber 131 in a fractional range during one complete revolution of the rotor 130. The chamber 131 sealed by the cover member 135 is acted upon by a vacuum during the time it is communicating with vacuum suction holes 141 and 142 through the rotary valve 132.

A vacuum packaging machine 200 has such construction, and a second rotor 150 is disposed adjacent said vacuum packaging machine 200, and groove type retainers 152 are disposed at the front ends of six arms 151 radially projecting from said rotor 150. The direction of the groove of each retainer 152 is at right angles to the longitudinal direction of the arm 151. The second rotor 150 is disposed so that the ends of two of the retainers 152 are opposed to two chambers 131 having their cover members opened. The second rotor 150 is intermittently rotated in increments of 60 degrees in harmony with the vacuum packaging machine 200 by a central shaft 153, and whenever it is stopped, two retainers 152 are opposed to two chambers 131.

Figure 19:
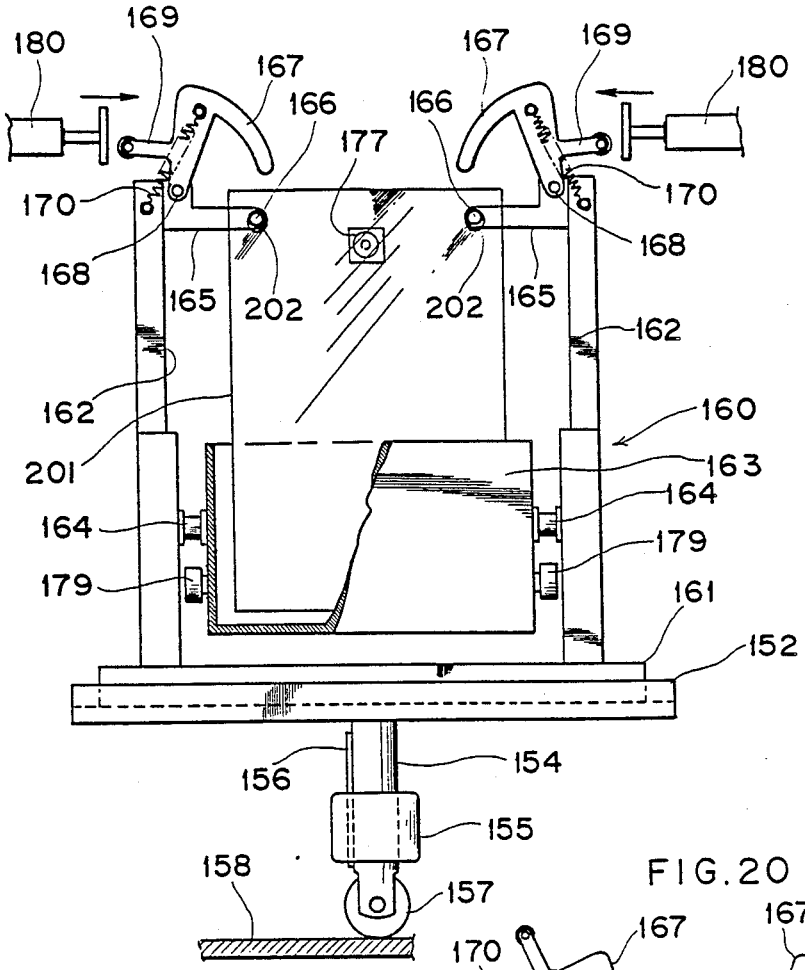
FIG. 19 is a view taken along the line XVIIII—XVIIII in FIG. 18.

As shown in FIG. 19, a leg shaft 152 extends downward from the lower surface of the retainer 152 and is vertically movably supported through a slide key 156 by a boss 155 on the front end of the arm 151 radially projecting from the second rotor 150. A wheel 157 installed on the lower end of the leg shaft 154 is placed on a circular rail 158, and a holder 160 is mounted on the retainer 152.

The holder 160 comprises a bucket 163 pivotally supported on pins 164 between two posts 162 erected on a seat plate 161. Brackets 165 project inward from the upper ends of the two posts 162, with bag supporting pins 166 extending transversely from the front ends of said brackets 165, and with hook-shaped bag spreading pawls 167 being supported on the upper portions of the brackets 165 through pins 168. Operating elements 169 project from the upper portions of the bag spreading pawls 167, and tension springs 170 are installed between the bag spreading pawls 167 and posts 162.

Figure 21:
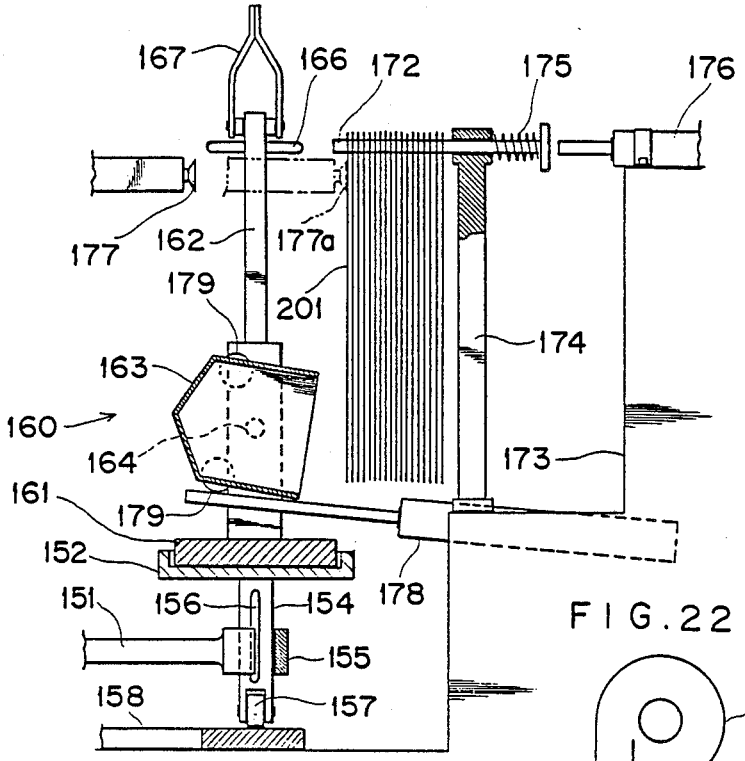
FIG. 21 is a view taken along the line XXI—XXI in FIG. 18.

In FIG. 18, at the first stop position for the retainers 152, a number of packaging bags 201 are hooked on two horizontal rods 172 by means of holes formed in said packaging bags 201 so that said packaging bags 201 are suspended from said rods 172. As shown in FIG. 21, the rods 172 are slidably supported in a support body 174 erected on the machine frame 172 and are normally held in the retracted standby position remote from the holder 160 on the retainer 152 under the urging force of springs 175. And when the retainer 152 is stopped opposed to the bags 201, a air cylinder 176 pushes out the two rods 172 against the two pins 166 of the retainer 152 against the urging forces of the springs 175. A vacuum cup 177 is pushed out as shown in phantom lines **177*a* to such a packaging bag 201 and pulls it in the direction of the pins 166**.

Figure 20:
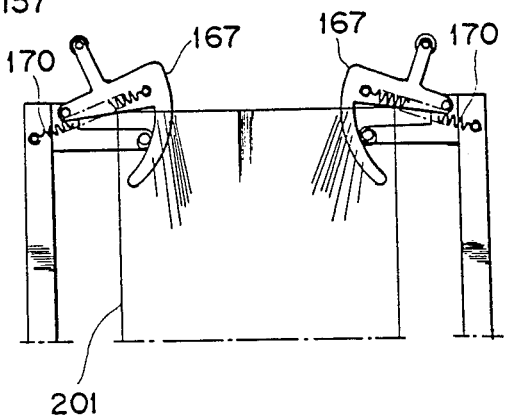
FIG. 20 is a view for explaining the operation of parts shown in FIG. 19.
Figure 22:
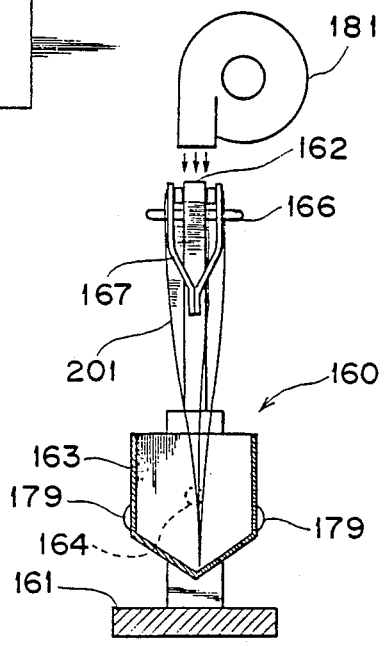
FIG. 22 is a view for explaining an operation for inflating a packaging bag.

At this time, the bucket 163 is turned horizontal around the axes of the pins 164 to make it easier to receive the bottom portion of the packaging bag 201. This is effected by two air cylinders 178 in FIG. 18 pushing pins 179 projecting from opposite ends of the backet 163 shown in FIG. 19. As a result, the packaging bad 201 is supported by the holder 160 as it is hooked at its two holes 202 on the pins 166. Thereafter, air cylinders 180 installed on opposite sides of the retainer 152 at that position push the operating elements 169 on the bag spreading pawls 167, whereby the two bag spreading pawls 167, as shown in FIG. 20, are inserted into the packaging bag 201 by the forces of the springs 170. As shown in FIG. 21, the bag spreading pawl 167 is thin at the upper end and thick at the bottom. Thus, when the bag spreading pawls 167 are inserted into the packaging bag 201, as shown in FIG. 22, the upper end of the packaging bag 201 is slightly opened and air is fed into the opening therein by a blower 181 to inflate the packaging bag.

Figure 23:
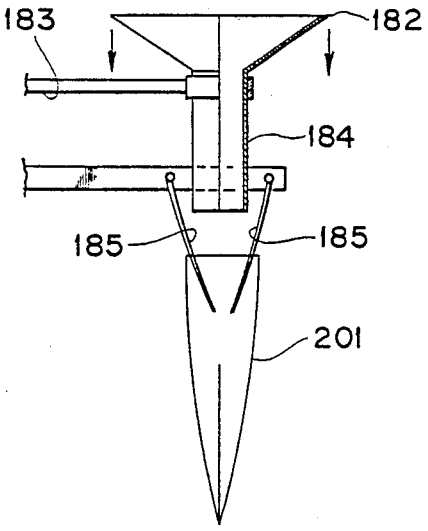
FIG. 23 is a view for explaining the principal portion taken along the line XXIII in FIG. 18.

When the packaging bag 201 is fed to the holder 160 in this manner, the arm 151 moves the retainer 152 and the holder 160 as a unit to the second position along the circular rail 158. In the second stop position (XXIII line section position) shown in FIG. 18, a hopper 182 is installed as shown in FIG. 23. When the hopper 182 is lowered by a rod 183, a sleeve 184 at the outlet port of the hopper 182 is inserted into the packaging bag 201 having its mouth opened by two flexible plates 185, and a commodity is filled into the packaging bag through the hopper 182.

Figure 24:
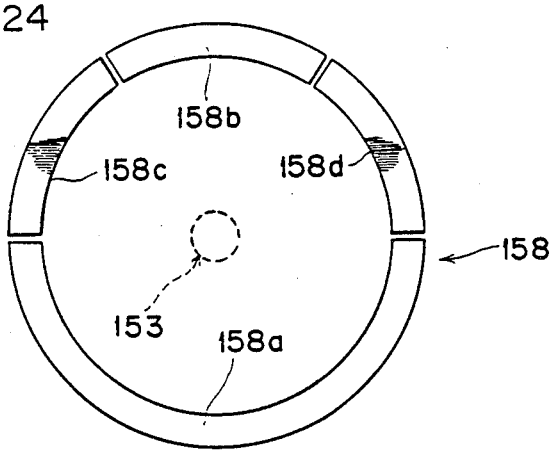
FIG. 24 is a view for explaining the construction of a rail.
Figure 25:
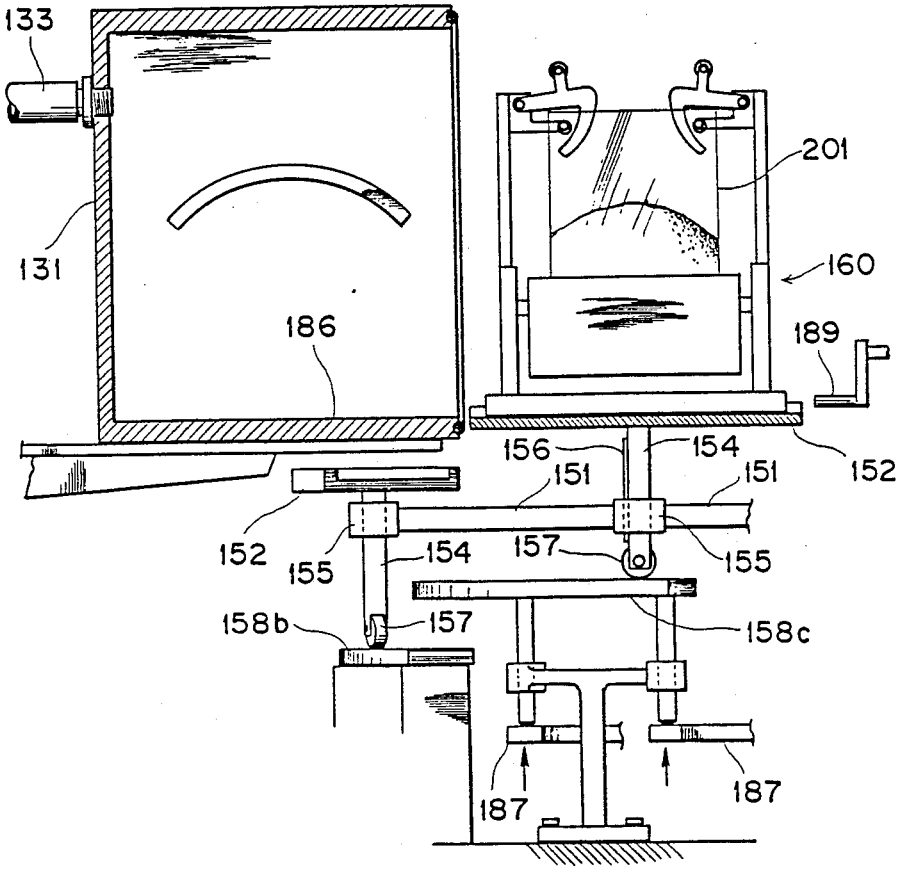
FIG. 25 is a sectional view taken along the line XXV in FIG. 18.

In FIG. 18, the retainer 152 is moved further to a third stop position. The rail 158 disposed below the moving path of the retainers 152 for guiding the rotary movement of the retainers 152 is divided into four pieces as shown in FIG. 24. The longest portion **158*a* and the portion 158*b* opposed thereto are immovable but the remaining two short portions 158*c* and 158*d* are adapted to be individually raised and lowered. That is, as shown in FIG. 25, when the retainer 152 comes to the position opposed to the chamber 131, the rail portion 158*c* is raised by members 187 until the upper surface of the retainer 152 is flush with the inside bottom surface 186 of the chamber 131. And the holder 160 on the retainer 152 is pushed into the chamber 131 by a pusher 189. The pusher 189, as shown in FIG. 18, is operated by an air cylinder 190. Thereupon, the retainer 152 is lowered together with the rail portion 158***c* so as not to interfere with the movement of the chamber 131 and is sent under the chamber 131 to a fourth stop position.

The retainer 152 is further sent under the chamber 131 to a fifth stop position opposed to the opening surface of another chamber 131 with its cover member 135 opened, as shown in FIG. 18. A packaging bag 210 having its mouth sealed under the action of a vacuum has already been received in this chamber 131 together with the holder 160, and as soon as the rail portion 158*d* shown in FIG. 24 is raised, a hook rod 192 is moved by an air cylinder 191 to pull the holder 160 out of the chamber 160 onto the retainer 152. Subsequently, when the retainer 152 is lowered together with the rail portion 158*d*, the retainer 152 is moved to the next position, or a sixth stop position, by the rotation of the rotor 150.

Positioned at said sixth position are a carrying-out conveyor 193 and a pair of air cylinders 194. When the bucket 163 is turned horizontal by said air cylinders 194, the packaging bag 201 having its mouth sealed slides down onto the carrying-out conveyor 193 as soon as its two holes 202 ship out of the pins 166.

The holder 160 having the vacuum-packaged product thus discharged therefrom is sent together with the retainer 152 again to the first stop position, where it receives a new packaging bag 201.

What is claimed is:

1. A method of vacuum-packaging a material in a soft flat packaging bag, comprising the steps of:

intermittently rotating a plurality of vacuum chambers along a circular path, supporting said packaging bags filled with said material respectively in a plurality of holders in such a manner that the bags are kept opened with their openings turned up, and transferring these holder along a transfer path, feeding one holder supporting a packaging bag filled with said material into a vacuum chamber from feeding means installed at the terminal end of said transfer path correspondingly to one of the stop positions of the vacuum chambers in said circular path, evacuating said vacuum chamber and closing the opening in the packaging bag while said vacuum chamber is rotating along said circular path, and opening said vacuum chamber to the surrounding atmosphere and taking out the holder from said vacuum chamber.

2. A method as set forth in claim 1, characterized in that the packaging bag is fed to the holder in the upstream region of said transfer path, a material is filled into said bag, and then said holder is fed to said feeding means.

3. An apparatus for vacuum-packaging a material in a soft flat packaging bag, comprising:

a holder movable on a transfer path and capable of supporting a soft packaging bag in the opened state with its opening turned up, means for feeding a packaging bag to said holder so as to support the bag in the holder, means for filling a material, on said transfer path, into the packaging bag supported on said holder, a plurality of vacuum chambers intermittently rotated along a circular path, means installed at the terminal end of said transfer path correspondingly to one of the stop positions of the vacuum chambers in said circular path, said means feeding one holder supporting a packaging bag filled with said material into a vacuum chamber, wherein while said vacuum chamber is rotating along said circular path, said vacuum chamber is evacuated and the opening in the packaging bag is closed, whereupon the vacuum chamber is opened to the surrounding atmosphere, and means for taking out the holder from said vacuum chamber opened to the surrounding atmosphere.

4. An apparatus as set forth in claim 3, characterized in that said holder feeding means comprises:

a groove for guiding the movement of the holder which is transferred to a place in front of the vacuum chamber along said transfer path by transferring means such as a chain, a storage section formed by depressing a portion of said groove, and a pusher movable between a position where it is received in said storage section to allow the holder to pass through the groove, and a position where it can push the holder, being transferred to the place in front of the vacuum chamber, into the vacuum chamber by being delivered from said storage section in the transfer direction of the holder.

5. An apparatus as set forth in claim 3, characterized in that:

the packaging bag is formed with a pair of hole means extending therethrough at opposite corners adjacent the opening, and the holder is provided with a pair of spaced pillars, and a pair of horizontal rod-like hooks attached to said pillars and passed through said hole means for suspending the packaging bag.

6. An apparatus as set forth in claim 5, characterized in that the means for feeding a packaging bag to the holder comprises:

a pair of rods disposed so that they correspond to the hooks in the transfer path, said rods being adapted to pass through holes in a number of packaging bags to suspend these packaging bags, and means for taking out one of the packaging bags supported on said rods to transfer it to the hooks on the holder.

7. An apparatus as set forth in claim 3, characterized in that the filling means comprises:

means for opening the open section of a packaging bag suspended from the hooks, and a hopper adapted to be inserted into the open section thus opened for feeding a material into said packaging bag.

8. An apparatus as set forth in claim 3, characterized in that the holder is formed with a hook-shaped recess and the take-out means has a pawl adapted to engage said recess to withdraw the holder from the vacuum chamber.

9. An apparatus as set forth in claim 3, characterized in that the holder comprises:

a pair of horizontal pins extending parallel to each other, a pair of comb members rotatably supported in opposed relationship by the pins and capable of supporting the bottom of the packaging bag filled with a solid material, a pair of vertical poles each integral with the comb member and rotatable around the axis of the pin, and a pair of clamp plates attached to the upper ends of the poles and adapted to clamp the packaging bag adjacent its opening from opposite sides to flatten the bag adjacent its opening by the rotation of the poles on the basis of the rotation of the comb members when the comb members support the packaging bag.

10. An apparatus as set forth in claim 3, characterized in that the holder has a recess capable of receiving said packaging bag in its opened state to support the packaging bag filled with a highly flowable material.

11. An apparatus for vacuum-packaging a material in a soft flat packaging bag comprising:

a plurality of vacuum chambers intermittently rotated along a first circular path, a plurality of retainers intermittently rotated along a second circular path disposed adjacent said first circular path in synchronism with the rotation of said vacuum chambers, wherein of said plurality of retainers in the stopped state, two are opposed to two vacuum chambers which are present at a packaging bag take-in position and at a packaging bag take-out position in the stopped state, said apparatus having a holder capable of supporting said soft packaging bag with its opening turned up, said holder being adapted so that is can be supported on said retainers, transferred between the retainer and vacuum chamber at said pair of opposed positions and received in said vacuum chambers, said apparatus having, along said second circular path, means for feeding a packaging bag to the holder on said retainer to cause said holder to support said packaging bag, means for filling a material into the packaging bag supported by said holder, and means for feeding said holder, with said material filled thereinto, from said retainer at said packaging bag take-in position into the vacuum chamber, wherein while said vacuum chamber is rotating along the first circular path, the chamber is evacuated, the opening in said packaging bag is sealed and thereafter the vacuum chamber is opened to the open air, said apparatus having, along said second circular path, means for taking-out the holder from the vacuum chamber at said packaging bag take-out position and delivering the holder onto the retainer, and means for transferring the packaging bag on the holder, delivered onto the retainer, to carrying out means.

12. An apparatus as set forth in claim 11, characterized in that:

the first and second circular paths are positioned to overlap each other at different levels in the vicinity of the packaging bag take-in and take-out positions, and said apparatus having, at said packaging bag take-in and take-out positions, means for raising and lowering the retainer in such a manner that the vacuum chamber is opposed to the retainer.

13. An apparatus as set forth in claim 11, characterized in that:

the holder has a bucket for receiving the lower portion of a packaging bag supported by said holder, and said bucket being adapted to be inverted for feeding the packaging bag onto the holder and for transferring the packaging bag from the holder to the carrying-out means.

* * * * *